US006938813B1

(12) United States Patent
Chen

(10) Patent No.: US 6,938,813 B1
(45) Date of Patent: Sep. 6, 2005

(54) NAIL STAPLER NOZZLE

(75) Inventor: Mu-Yu Chen, Taichung (TW)

(73) Assignee: Aplus Pneumatic Corp., Taichung Hsien (TW)

( * ) Notice: Subject to any disclaimer, the term of this patent is extended or adjusted under 35 U.S.C. 154(b) by 0 days.

(21) Appl. No.: 10/822,474

(22) Filed: Apr. 12, 2004

(51) Int. Cl.[7] ..... B25C 3/00
(52) U.S. Cl. ..... 227/120; 227/121; 227/123; 227/127
(58) Field of Search ..... 227/109, 120, 227/121, 123, 127, 132, 134, 146

(56) References Cited

U.S. PATENT DOCUMENTS 5,649,660 A * 7/1997 Akiba et al. ..... 227/8
5,692,665 A * 12/1997 Lee ..... 227/109
5,873,509 A * 2/1999 Liao ..... 227/109
6,318,617 B1 * 11/2001 Cheng ..... 227/109

* cited by examiner

*Primary Examiner*—Stephen F. Gerrity
*Assistant Examiner*—Chukwurah Nathaniel
(74) *Attorney, Agent, or Firm*—Alan D. Kamrath; Nikolai & Mersereau, P.A.

(57) ABSTRACT

A nail stapler includes a magazine, a nozzle and a hammering device. The magazine stores nails. The nozzle prevents jamming via allowing only a leading one of the nails to the hammering device. The hammering device is capable of hammering the leading one of the nails more than once until it hammers the leading nail completely into an object.

10 Claims, 11 Drawing Sheets

NAIL STAPLER NOZZLE

FIELD OF INVENTION

The present invention relates to a nail stapler and, more particularly, to a nail stapler nozzle.

BACKGROUND OF INVENTION

A typical nail stapler includes a magazine for storing nails, a nozzle and a hammering device for driving the nails from the magazine through the nozzle one at a time. There is a certain nail stapler that includes a hammering device capable of hammering a nail many times until it hammers the nail into an object completely. It, however, quite often occurs that when hammering the nail the second or third time, the hammering device hammers the next nail by mistake. This hammering by mistake causes a jam in the nozzle. To clear the jam and reload the nails is troublesome.

The present invention is therefore intended to obviate or at least alleviate the problems encountered in the prior art.

SUMMARY OF INVENTION

It is the primary objective of the present invention to provide a nail stapler including a magazine for storing nails, a jam-proof nozzle and a hammering device capable of hammering a leading one of the nails many times until it hammers the leading nail into an object completely.

According to the present invention, a nail stapler includes a magazine, a nozzle and a hammering device. The magazine stores nails. The nozzle prevents jamming via allowing only a leading one of the nails to the hammering device. The hammering device is capable of hammering the leading one of the nails more than once until it hammers the leading nail completely into an object.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the drawings.

DETAILED DESCRIPTION OF PREFERRED EMBODIMENT

Figure 1:
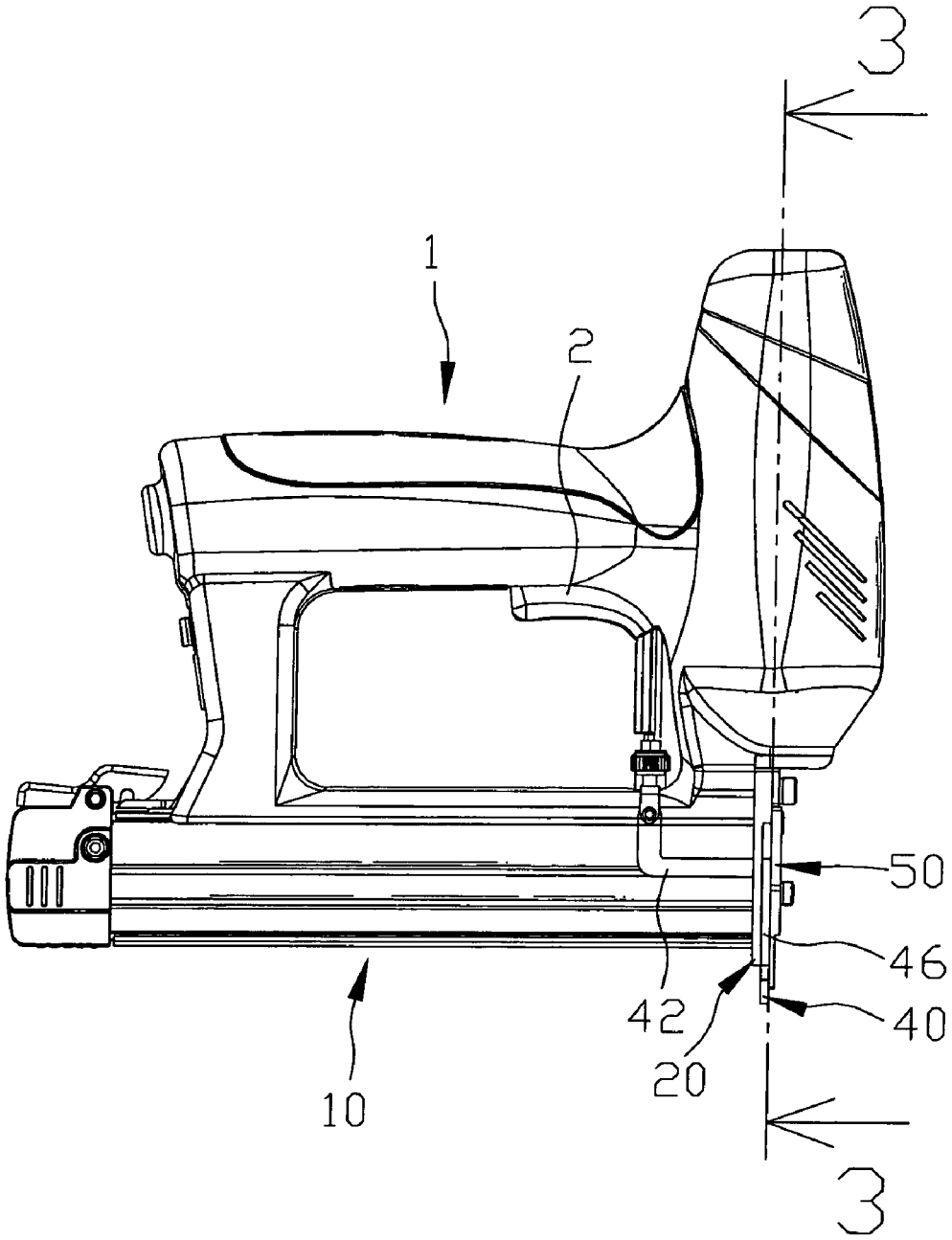
FIG. 1 is a right side view of a nail stapler including a magazine for storing nails, a jam-proof nozzle and a hammering device according to the preferred embodiment of the present invention.

Referring to FIG. 1, according to the preferred embodiment of the present invention, a nail stapler includes a magazine 10 for storing nails 3 shown in FIGS. 3 to 11, a jam-proof nozzle and a hammering device 1 capable of hammering a leading one of the nails 3 more than once until it hammers the leading nail 3 completely into an object such as those marked with "60" and "70" in FIGS. 4 to 11.

The hammering device 1 includes a trigger 2 and a hammer 4 shown in FIGS. 3 to 11. The hammering device 1 can be actuated via pulling the trigger 2 so as to move the hammer 4. The hammering device 1 will not further be illustrated in detail for being conventional.

Figure 2:
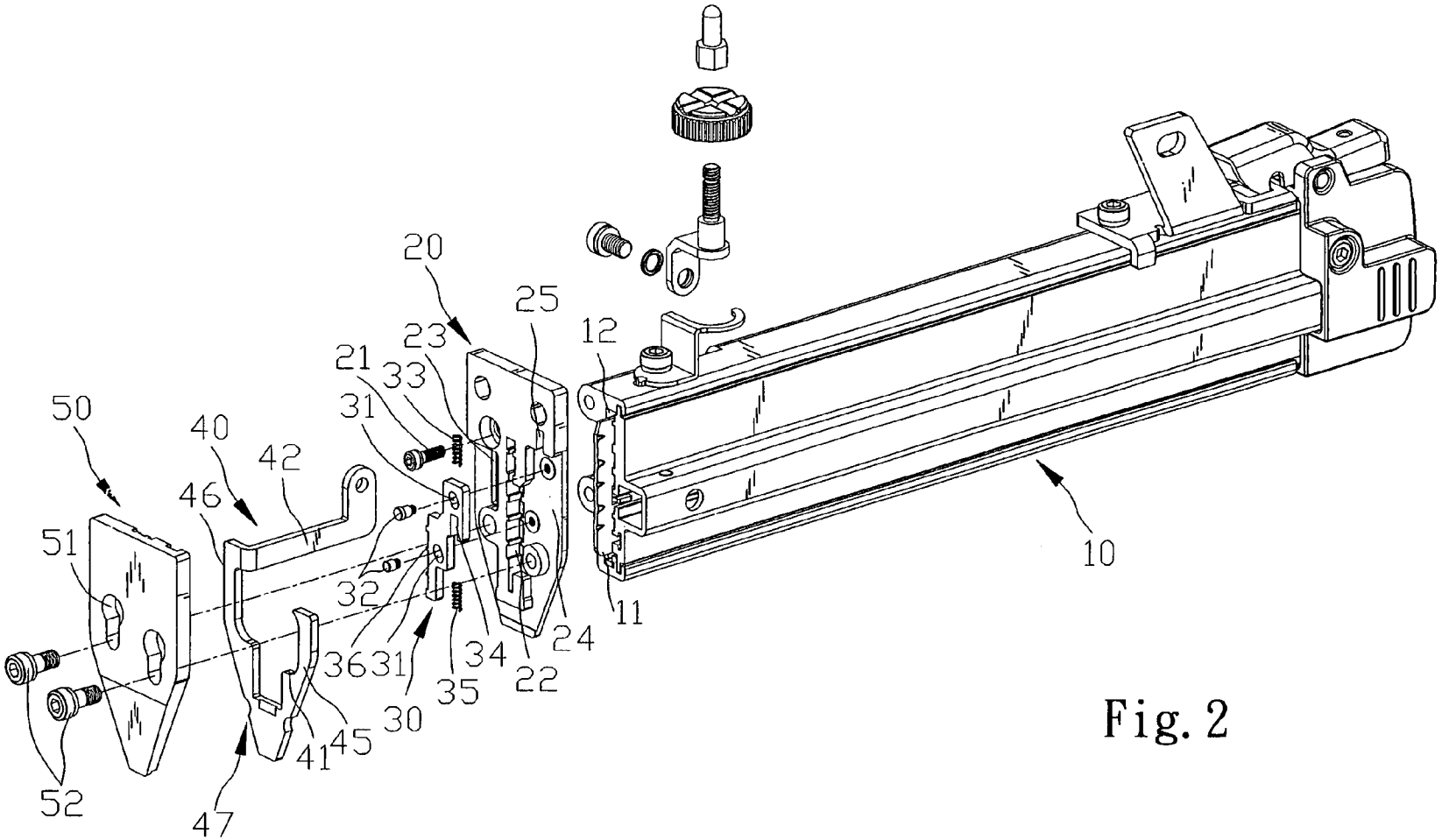
FIG. 2 is an exploded view of the magazine and the nozzle in FIG. 1.

Referring to FIG. 2, the magazine 10 includes a space 12 between two walls (not numbered) so as to store the nails 3. A spring-biased pusher 11 is movable in the space 12 so as to push the nails 3 to the nozzle.

The nozzle includes a plate 20, a restraint 30, a security device 40 and a cover 50.

The plate 20 is attached to the magazine 10 by a screw 21. The plate 20 includes a slot 22 through which the nails 3 are transferred, a slot 23 near the slot 22, a cavity 24 in a front face thereof and a cavity 25 in communication with the cavity 24.

The restraint 30 includes a flat configuration. The restraint 30 includes two inclined slots 31, a recess 34 and at least one protrusion 36 projecting from an edge thereof.

The security device 40 includes a V-shaped body 47 and an arm 42 in a plane vertical to that of the V-shaped body 47. The V-shaped body 47 includes a first prong 45 and a second prong 46. A shoulder 41 is formed on the first prong 45. The arm 42 projects from the second prong 46.

The cover 50 includes two apertures 51.

Figure 3:
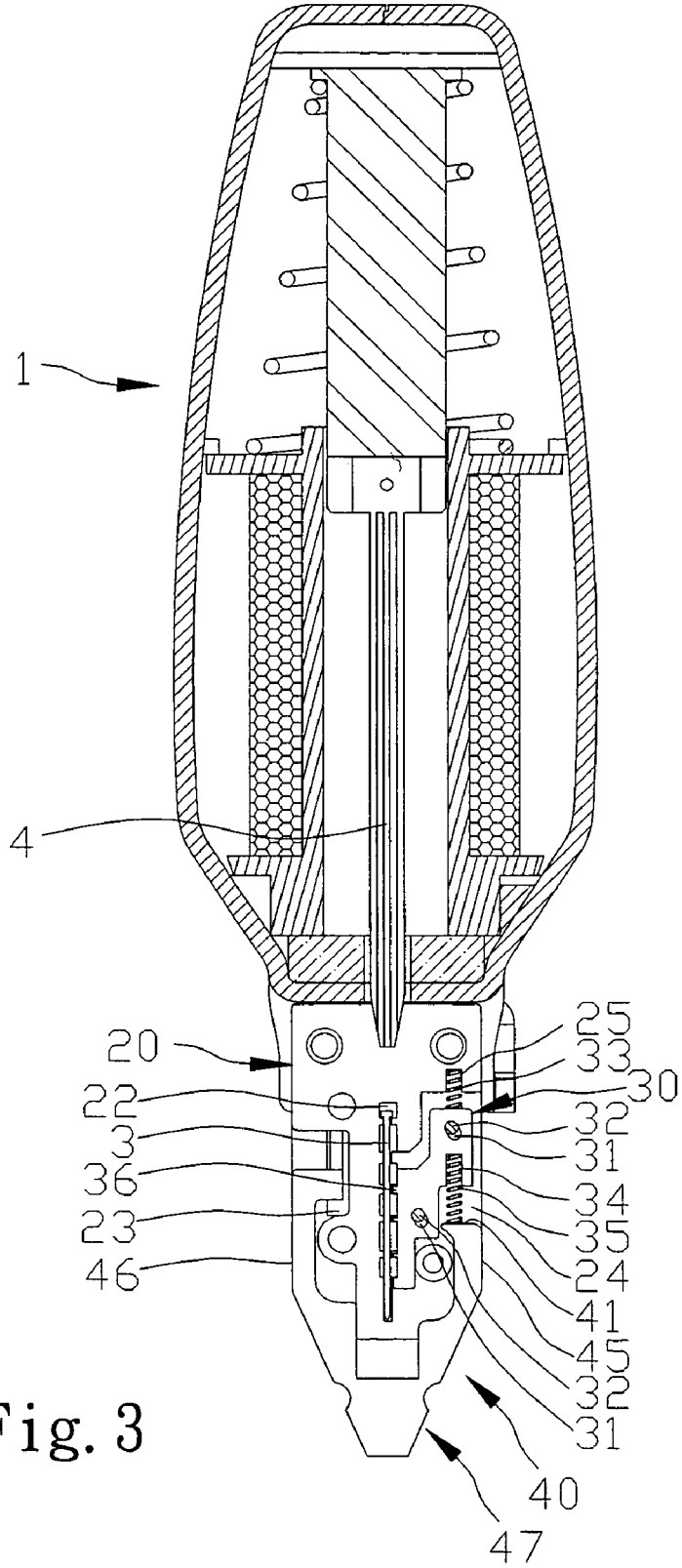
FIG. 3 is a cross-sectional view of the nail stapler taken along a line 3—3 in FIG. 1.

Referring to FIG. 3, to form the nozzle, the restraint 30 is put movably in the cavity 24. Two screws 32 are driven into the plate 20 through the inclined slots 31. Thus, the restraint 30 is movable along an inclined path in the cavity 24 between an upper left position and a lower right position. The protrusion 36 is located next to the slot 22.

The arm 42 is inserted through the slot 23 to a side of the magazine 10 for connection with elements (not numbered) for controlling the trigger 2. The security device 40 is movable along a vertical path between an upper position and a lower position relative to the plate 20. The slot 22 and the restraint 30 are put between the prongs 45 and 46. A spring 33 is put in the cavity 25 and compressed between the plate 20 and the restraint 30. A spring 35 is put in the recess 34 and compressed between the restraint 30 and the shoulder 41. The restraint 30 is moved to the lower right position because of the spring 33. The security device 40 is moved to the lower position because of the spring 35.

Referring to FIG. 2, two screws 52 are driven into the plate 20 through the apertures 51. Thus, the plate 20, the restraint 30, the security device 40 and the cover 50 are kept together.

Figure 4:
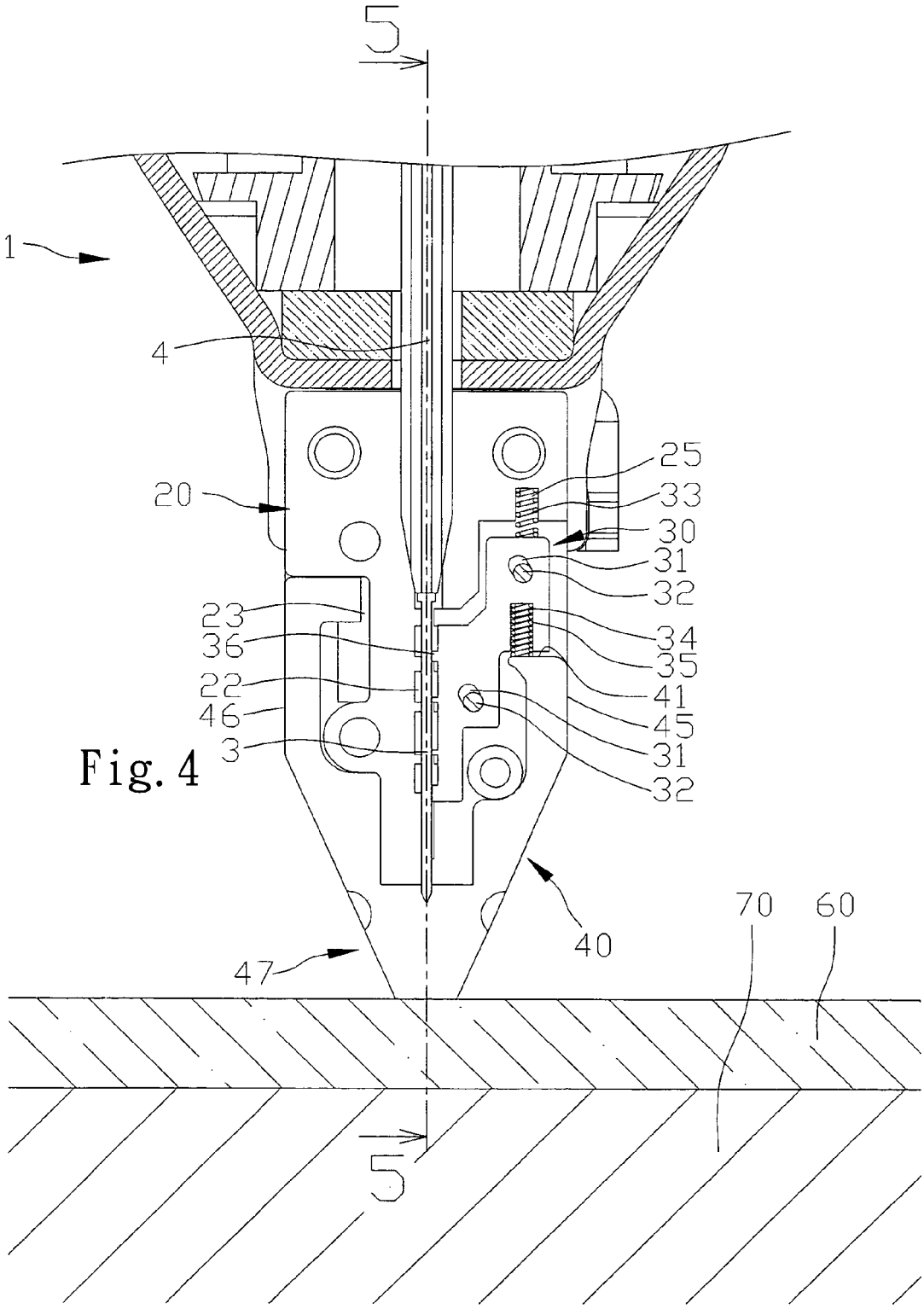
FIG. 4 is an enlarged partial view of the nail stapler in FIG. 3 but shows the nail stapler in another position.
Figure 5:
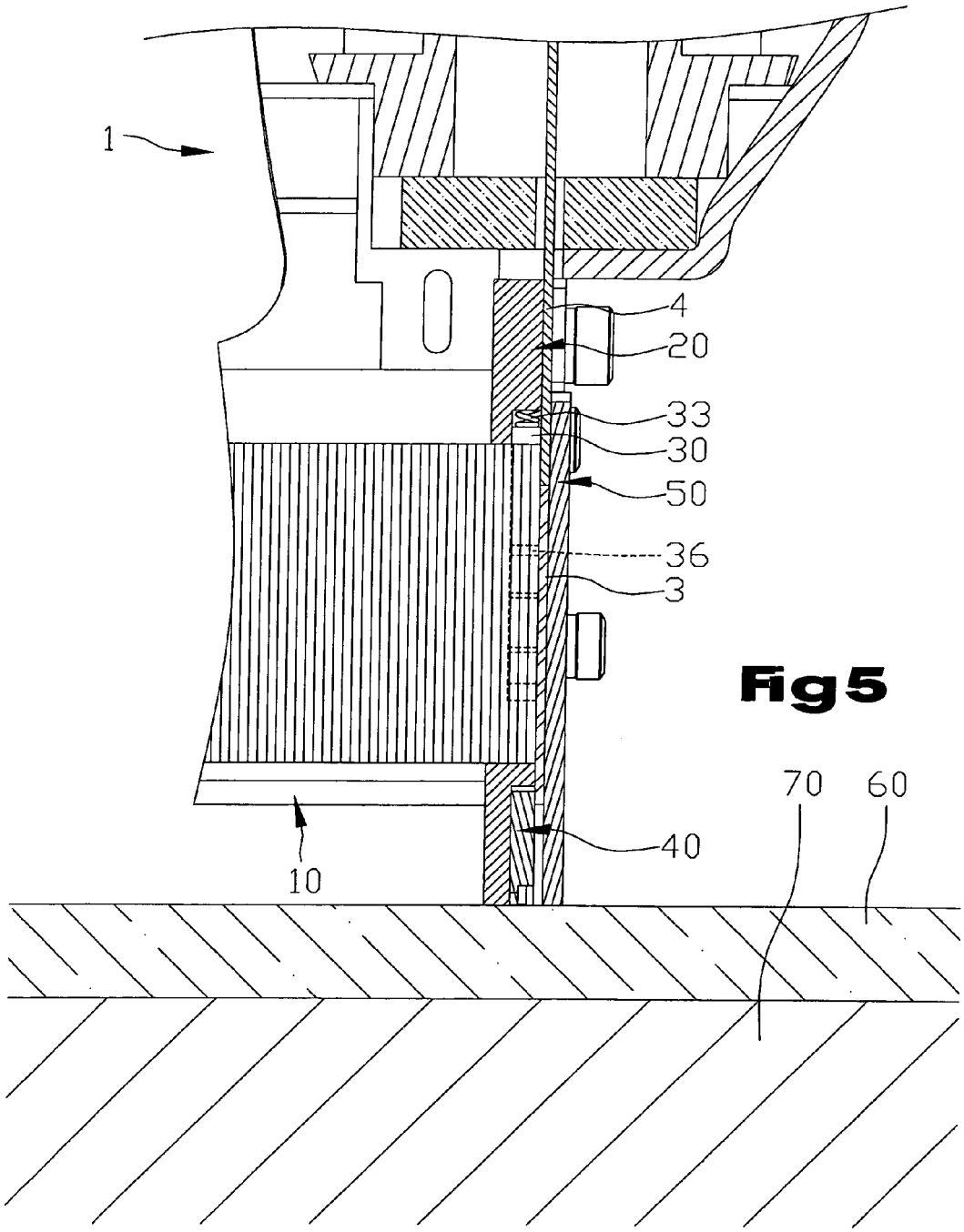
FIG. 5 is a cross-sectional view of the nail stapler taken along a line 5—5 in FIG. 4.

Referring to FIGS. 4 and 5, the security device 40 is put against the object 60 so that it is moved to the upper position. The restraint 30 is moved to the upper left position by the security device 40. As clearly shown in FIG. 5, a leading one of the nails 3 is put under the hammer 4. As clearly shown in FIG. 4, the next three of the nails 3 are pressed by the protrusion 36. The next three of the nails 3 cannot be pushed towards the hammer 4 by the spring-biased pusher 11. No nail 3 other than the leading nail 3 can be driven by the hammer 4. Hence, a jam is prevented.

Figure 6:
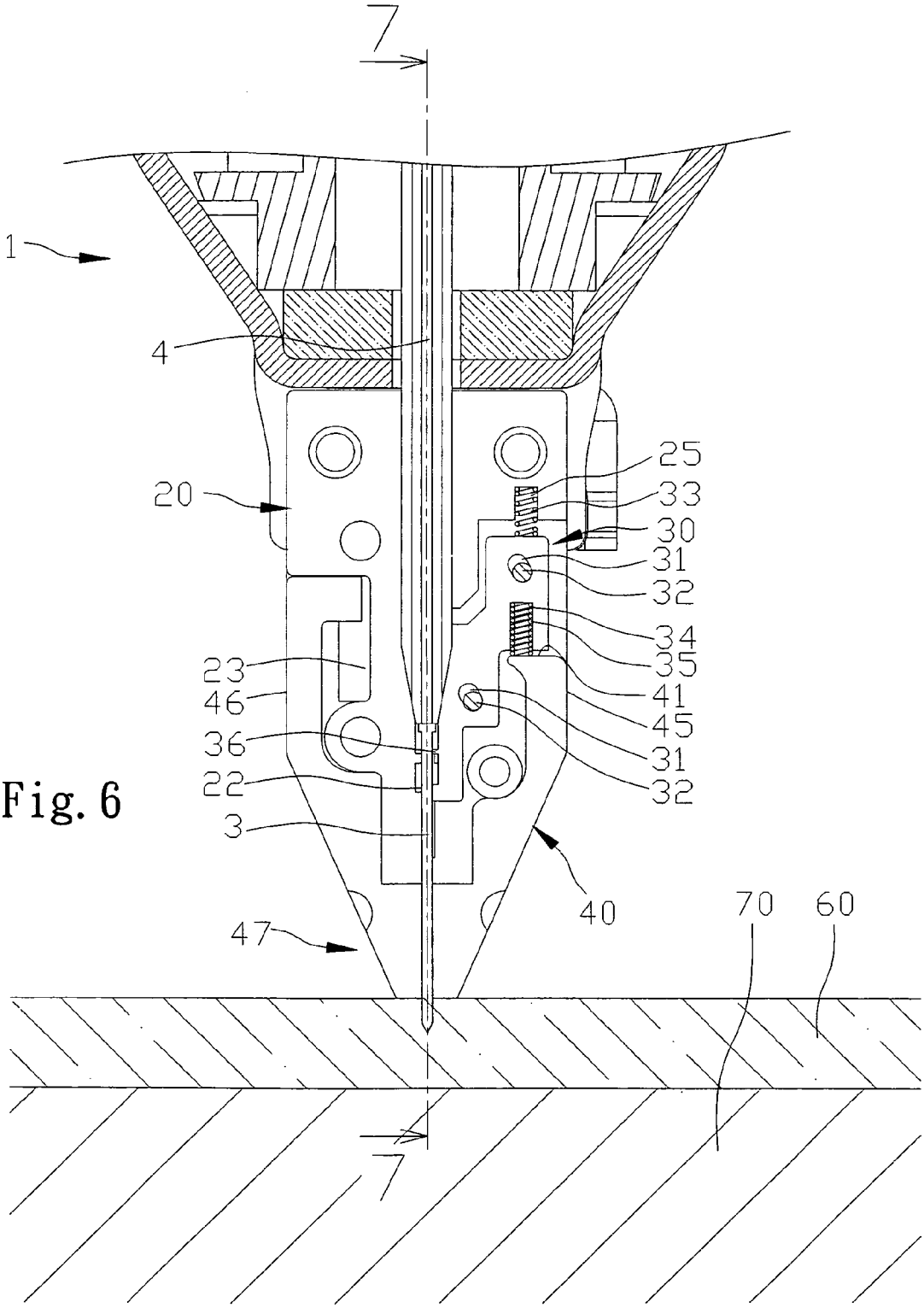
FIG. 6 is similar to FIG. 4 but shows the nail stapler and a leading nail in another position.
Figure 7:
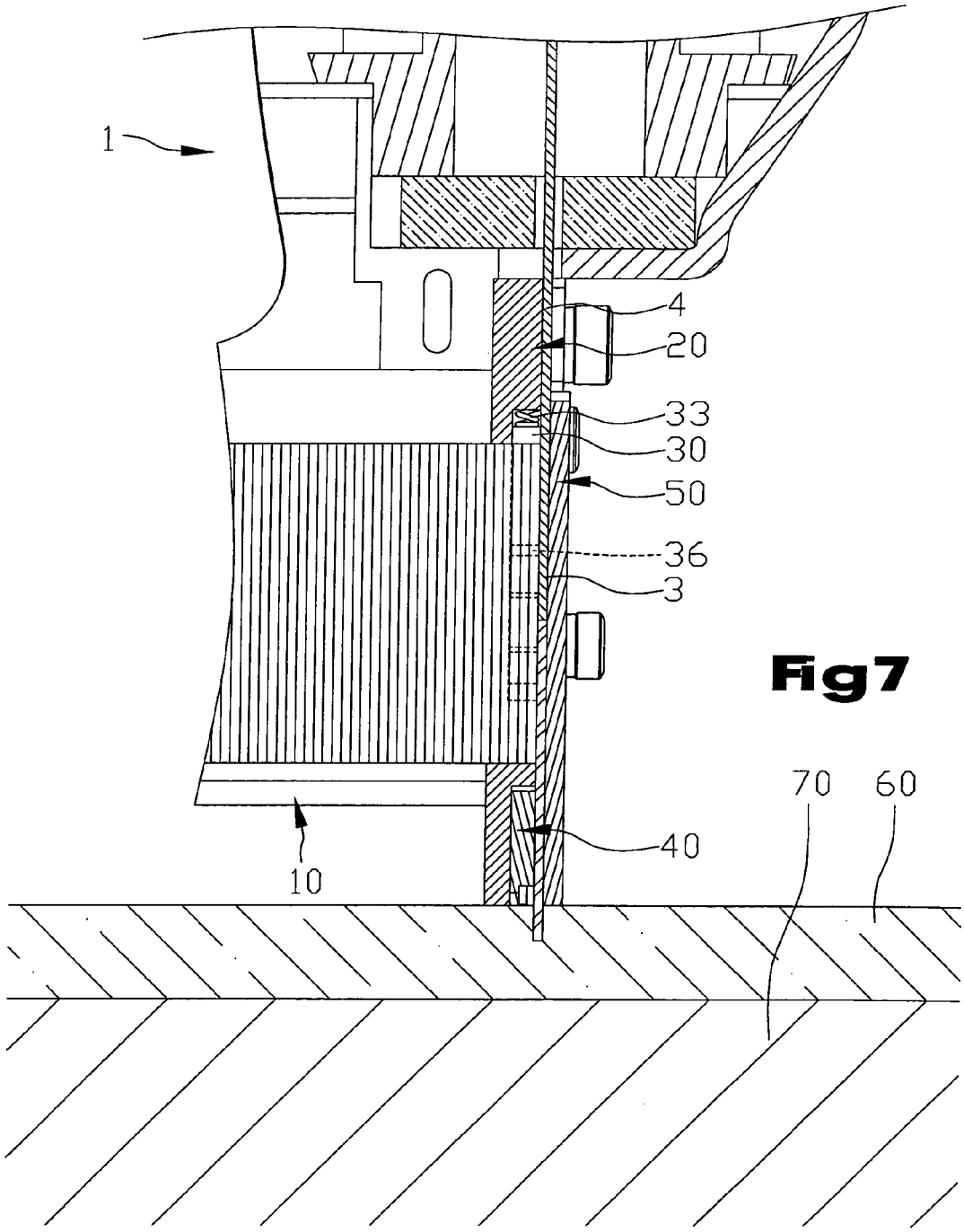
FIG. 7 is a cross-sectional view of the nail stapler taken along a line 7—7 in FIG. 6.
Figure 8:
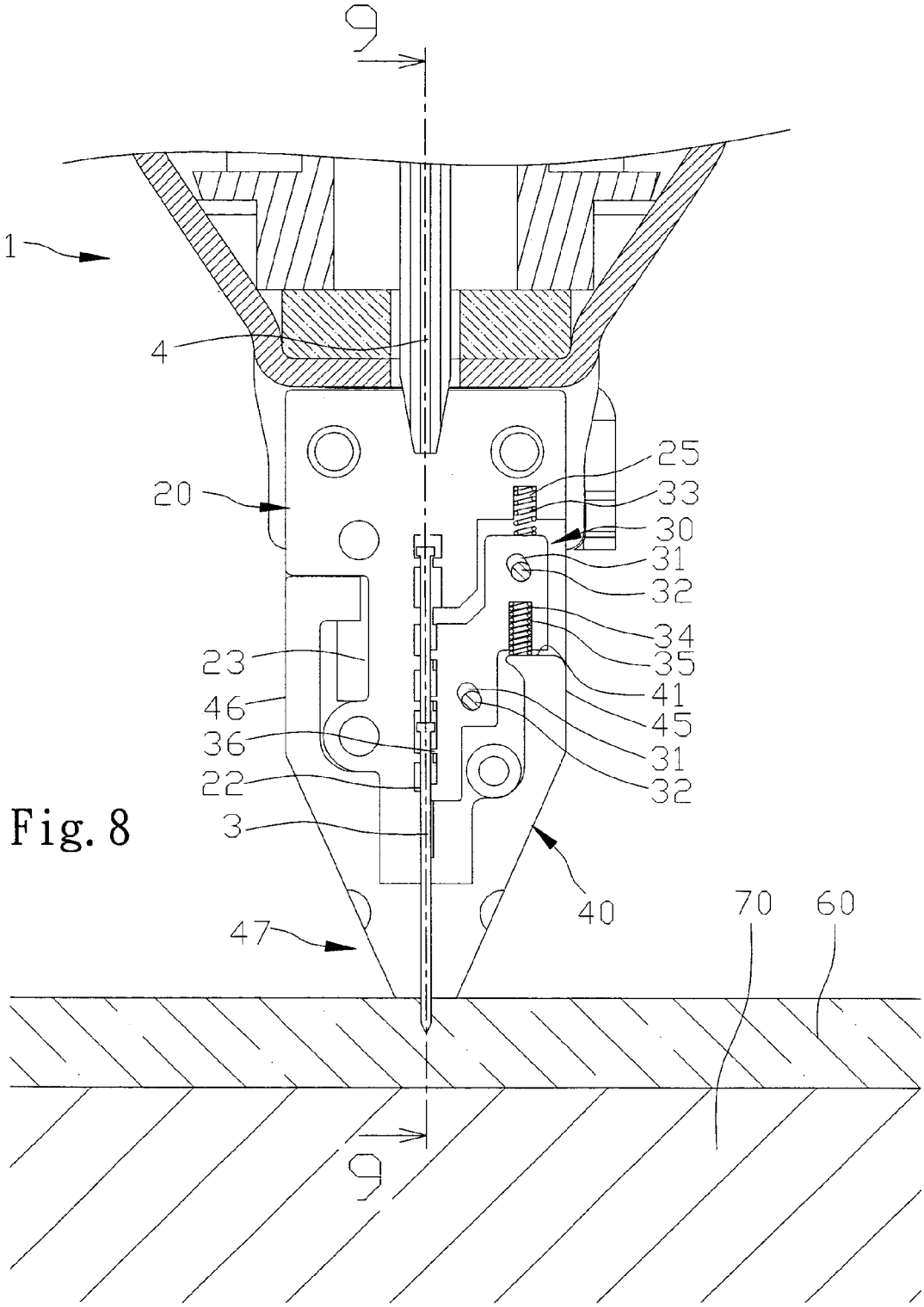
FIG. 8 is similar to FIG. 6 but shows the nail stapler and the leading nail in another position.
Figure 9:
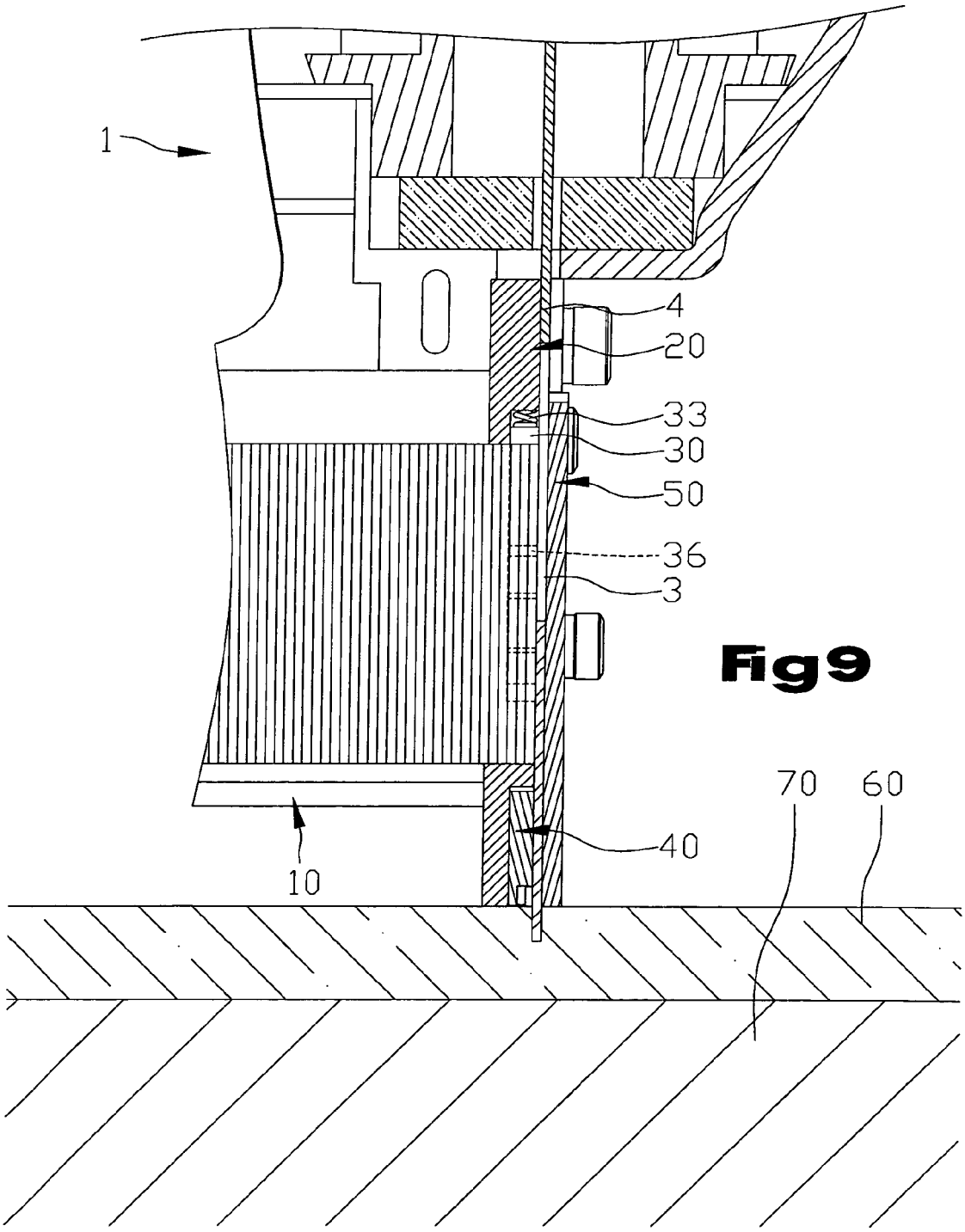
FIG. 9 is a cross-sectional view of the nail stapler taken along a line 9—9 in FIG. 8.
Figure 10:
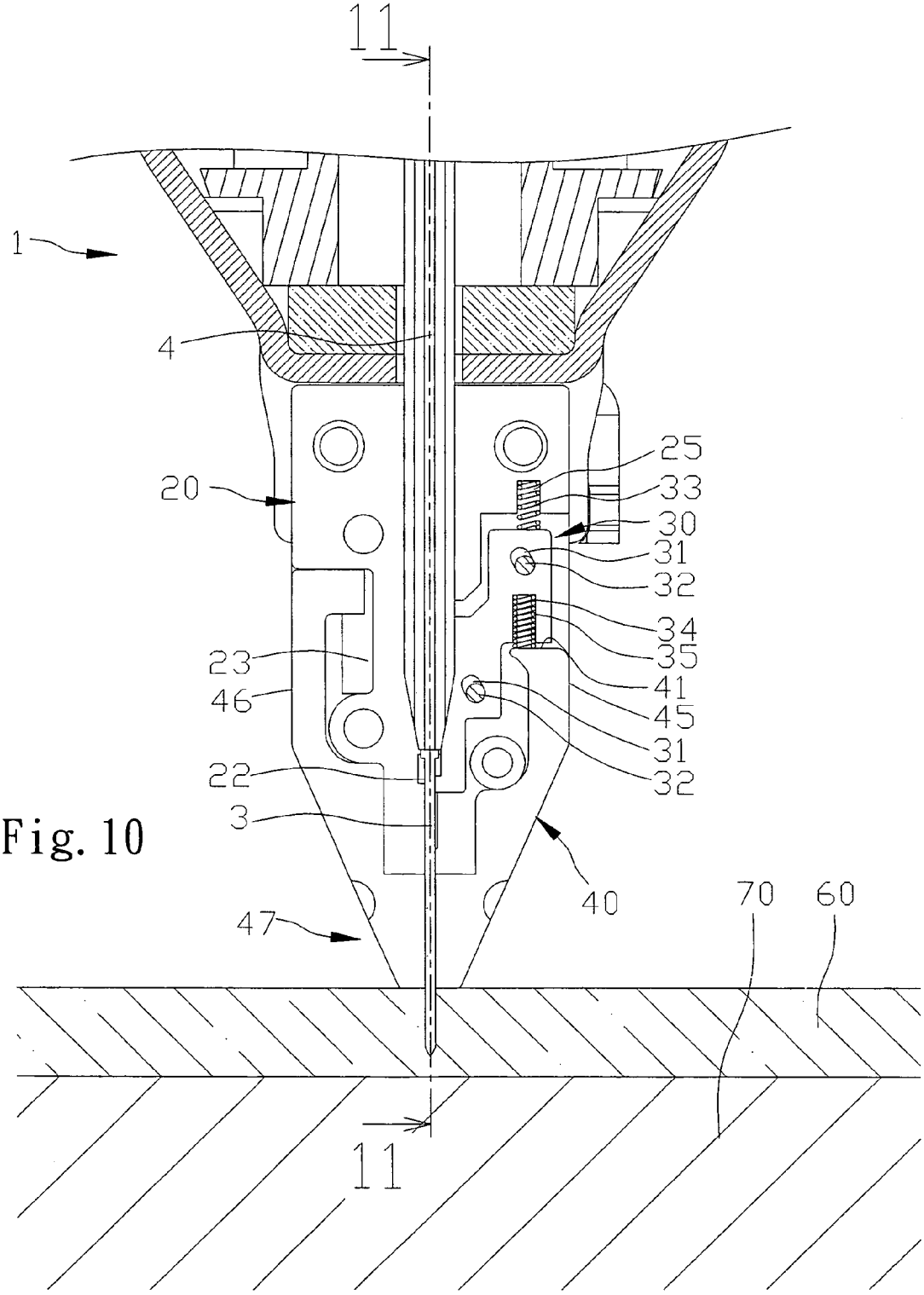
FIG. 10 is similar to FIG. 8 but shows the nail stapler and the leading nail in another position.
Figure 11:
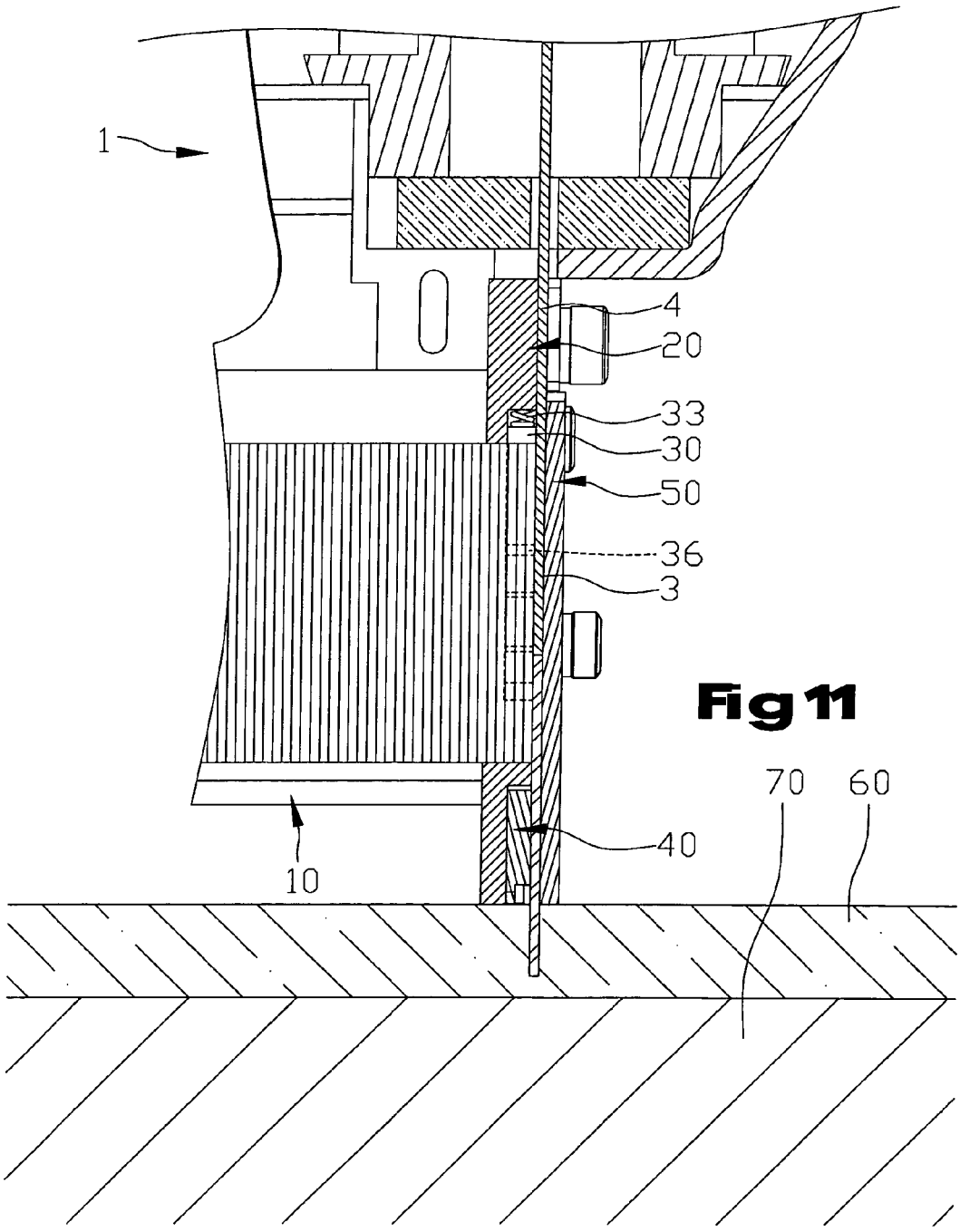
FIG. 11 is a cross-sectional view of the nail stapler taken along a line 11—11 in FIG. 10.

Referring to FIGS. 6 and 7, the leading nail 3 is driven into the object 60 via the hammer 4. Referring to FIGS. 8 and 9, the hammer 4 is returned to its original position. Referring to FIGS. 10 and 11, the leading nail 3 is driven further into the object 60 via the hammer 4. This process can repeat until the leading nail 3 is driven into the object 70 through the object 60. During this process, the next three nails 3 are pressed by the protrusion 36. The next three of the nails 3 cannot be pushed towards the hammer 4 by the spring-biased pusher 11. No nail 3 other than the leading nail 3 can be driven by the hammer 4. Hence, a jam is prevented.

The security device 40 can be removed from the object 60. The restraint 30 is moved to the lower right position by the spring 33. The security device 40 is moved to the lower position by the spring 35. The next three nails 3 are released from the protrusion 36. The remaining nails 3 are pushed towards the hammer 4 via the spring-biased pusher 11. The next nail 3 is put under the hammer 4. The next nail 3 can be driven by the hammer 4.

The present invention has been described through detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A nail stapler including:

a magazine for storing nails;

a jam-proof nozzle; and a hammering device capable of a hammering a leading one of the nails more than once until hammering the leading one of the nails completely into an object, wherein the hammering device includes a trigger and a hammer that is moved when the trigger is pulled, wherein the jam-proof nozzle includes a plate including a slot through which the nails can be transferred from the magazine, a restraint for restraining at least one of the nails other than the leading one of the nails to allow only the leading one of the nails to the hammer to prevent jamming, and a security device for controlling both of the restraint and the trigger.

2. The nail stapler according to claim 1 wherein the magazine includes a space in order to store the nails and a spring-biased pusher in the space so as to push the nails to the jam proof nozzle.

3. The nail stapler according to claim 1 wherein the security device includes a V-shaped body for controlling the restraint and an arm raised from the V-shaped body for controlling the trigger.

4. The nail stapler according to claim 3 wherein the V-shaped body includes a first prong for controlling the restraint and a second prong from which the arm is raised.

5. The nail stapler according to claim 1 wherein the security device is movable in a vertical path relative to the plate while the restraint is movable in an inclined path relative to the plate.

6. The nail stapler according to claim 5 wherein the restraint includes two inclined slots through which two fasteners are driven into the plate.

7. The nail stapler according to claim 1 wherein the restraint includes a protrusion for pressing at least one of the nails other than the leading nail.

8. The nail stapler according to claim 1 including a spring compressed between a portion of the plate and a portion of the restraint.

9. The nail stapler according to claim 1 including a spring compressed between a portion of the restraint and a portion of the security device.

10. The nail stapler according to claim 1 wherein the plate includes a cavity in a front face thereof for receiving the restraint.

* * * * *